US010498042B2

(12) United States Patent
Kim et al.

(10) Patent No.: US 10,498,042 B2
(45) Date of Patent: Dec. 3, 2019

(54) REFLECTION FREQUENCY CONVERSION DEVICE USING ACTIVE METAMATERIAL SURFACE AND ECM SYSTEM

(71) Applicant: KYUNGPOOK NATIONAL UNIVERSITY INDUSTRY-ACADEMIC COOPERATION FOUNDATION, Daegu (KR)

(72) Inventors: Hongjoon Kim, Daegu (KR); Hongwoo Park, Gyeongsangbuk-do (KR); Heeje Han, Gyeongsangnam-do (KR); Soonwoo Park, Gyeongsangnam-do (KR)

(73) Assignee: KYUNGPOOK NATIONAL UNIVERSITY INDUSTRY-ACADEMIC COOPERATION FOUNDATION, Daegu (KR)

( * ) Notice: Subject to any disclaimer, the term of this patent is extended or adjusted under 35 U.S.C. 154(b) by 408 days.

(21) Appl. No.: 15/350,878

(22) Filed: Nov. 14, 2016

(65) Prior Publication Data

US 2017/0141477 A1 May 18, 2017

(30) Foreign Application Priority Data

Nov. 13, 2015 (KR) ..... 10-2015-0159450
Sep. 26, 2016 (KR) ..... 10-2016-0122977

(51) Int. Cl.
*H01Q 15/00* (2006.01)
*H01Q 15/14* (2006.01)
*H01Q 1/38* (2006.01)

(52) U.S. Cl.
CPC ..... *H01Q 15/0086* (2013.01); *H01Q 15/0066* (2013.01)

(58) Field of Classification Search
CPC .. H01Q 15/0086; H01Q 15/0066; H01Q 3/44; H01Q 15/14; H01P 1/2005; H01P 3/081
See application file for complete search history.

(56) References Cited

U.S. PATENT DOCUMENTS 6,538,621 B1 * 3/2003 Sievenpiper ..... H01Q 9/0442 343/700 MS
2016/0013531 A1 * 1/2016 Casse ..... H01Q 3/46 333/161

FOREIGN PATENT DOCUMENTS

KR 10-2007-0086427 A 8/2007
KR 10-2012-0089726 A 8/2012
KR 10-2013-0131620 A 12/2013

* cited by examiner

*Primary Examiner* — Hai V Tran
*Assistant Examiner* — Michael M Bouizza
(74) *Attorney, Agent, or Firm* — Novick, Kim & Lee, PLLC; Sang Ho Lee

(57) ABSTRACT

A reflection frequency conversion device using an active metamaterial surface comprising: a plate-shaped active metamaterial surface which is configured to continuously convert a phase of a reflected wave by changing surface impedance characteristics in accordance with input voltage; and an arbitrary waveform generator which provides a voltage waveform capable of linearly changing the phase of the reflected wave in accordance with time to the metamaterial surface, where a reflection frequency generated on the metamaterial surface is converted in accordance with a frequency of the voltage waveform provided from the arbitrary waveform generator, where a plurality of metamaterial unit structures are periodically disposed on the metamaterial surface, and where the metamaterial unit structure is a high impedance surface (HIS) provided with a variable capacitor, (Continued)

and the capacitance of the variable capacitor is changed in accordance with applied voltage to change the phase of the reflected wave.

8 Claims, 11 Drawing Sheets

METAMATERIAL SURFACE(101) METAMATERIAL UNIT CELL(301)

METAMATERIAL SURFACE(102) METAMATERIAL UNIT CELL(302)

METAMATERIAL SURFACE(103) METAMATERIAL UNIT CELL(303)

METAMATERIAL SURFACE(104) METAMATERIAL UNIT CELL(304)

METAMATERIAL SURFACE(105) METAMATERIAL UNIT CELL(305)

METAMATERIAL SURFACE(106) METAMATERIAL UNIT CELL(306)

REFLECTION FREQUENCY CONVERSION DEVICE USING ACTIVE METAMATERIAL SURFACE AND ECM SYSTEM

BACKGROUND

The present invention relates to a reflection frequency conversion device using an active metamaterial surface capable of converting the frequency of a reflected wave by providing a voltage waveform changed with time, to an active metamaterial surface capable of changing a phase of a reflected wave by coupling a variable capacitor to a high impedance surface (HIS), and an ECM system.

Generally, when it communicates by using an electromagnetic wave, in the majority of cases, the conductor disturbs the communication.

In other words, when an antenna is formed at a PCB substrate, since a metal grounding plate is operated as a shorted circuit from a position of propagation, the reflection coefficient has "−1". At this time, in case of the reflection coefficient of "−1", it is reflected in the same size. However, the phase is reversed to 180 degrees. In case of the propagation reflected from the metal grounding plate, it can be seen that the phase thereof is reversed to 180 degrees through the propagation radiated from the antenna to be reflected. Due to this phenomenon, since the offset is generated between the reflected propagation and the propagation radiated from the antenna, it causes the efficiency reduction of the antenna radiation.

In order to minimize the above phenomenon, conventionally, it has been proposed a High-profile antenna using a PCB substrate having a thick thickness more than a predetermined thickness. However, in case of the antenna having the thick PCB substrate, since the thickness of the antenna is increased and the flexibility of the antenna is reduced, it has trouble in producing the antenna of requiring compactness/softening like a cell phone antenna.

In order to minimize these problems, recently, it has been proposed a High Impedance Surface (HIS) structure. In the HIS structure, a resonance phenomenon is generated at certain frequencies through the transformation of a surface structure in that a groove etc. having a periodic structure is formed at the conventional metal grounding plate. Here, the value of the surface impedance of the HIS is infinity at the resonance frequency, unlike the metal in that the value is "0". Accordingly, the phase of the reflective wave is "0" at the resonance frequency and the phase of the reflected propagation is the same as that of the propagation radiated from the antenna, so that it can enhance the performance of the antenna.

However, the surface impedance characteristic of the HIS is restricted owing to the shape of the metal structure engraved on the substrate.

On the other hand, recently, researches for using as a military purpose in addition to the performance improvement of the antenna for the HIS have been considerably progressed in foreign countries.

In other words, the modern aircrafts have many antennas and the antennas have various purposes such as a jamming, an interception, a communication, and a radar etc.

Accordingly, in order to expand the applicability thereof, it requires a new HIS structure capable of freely transforming the electromagnetic waves flowed on the surface according to the circumstances.

SUMMARY OF THE INVENTION

The invention has been made in consideration of above circumstances, and is to provide a reflection frequency conversion device using an active metamaterial surface capable of converting the frequency of a reflected wave by providing a voltage waveform changed with time, to an active metamaterial surface capable of changing a phase of a reflected wave by coupling a variable capacitor to a high impedance surface (HIS), and an ECM system.

According to an aspect of the invention to achieve the object described above, there is provided a reflection frequency conversion device using an active metamaterial surface including: a plate-shaped active metamaterial surface which is configured to continuously convert a phase of a reflected wave by changing surface impedance characteristics in accordance with input voltage; and an arbitrary waveform generator which provides a voltage waveform capable of linearly changing the phase of the reflected wave in accordance with time to the metamaterial surface, wherein the reflection frequency generated on the metamaterial surface is converted in accordance with the frequency of the voltage waveform provided from the arbitrary waveform generator, wherein a plurality of metamaterial unit structures are periodically disposed on the metamaterial surface, and wherein the metamaterial unit structure is a high impedance surface (HIS) provided with a variable capacitor, and the capacitance of the variable capacitor is changed in accordance with applied voltage to change the phase of the reflected wave.

Preferably, in the metamaterial unit structure, a dielectric plate with a predetermined thickness is disposed between a conductive lower plate and upper plate; the upper plate comprises a band-type first pattern plate with a hollow and a second pattern plate formed in the hollow of the first pattern plate, wherein a band-shaped line pattern formed by a separation interval is formed between the first pattern plate and the second pattern plate, thereby forming a capacitance component; and a variable capacitor is coupled between the first pattern plate and the second pattern plate and a center of the second pattern plate is connected to the lower plate via a via-pin thereby forming a grounding.

Preferably, at least one variable capacitor is coupled between the first pattern plate and the second pattern plate, wherein in a polygonal metamaterial unit structure, one variable capacitor is disposed on each side thereof.

Preferably, the variable capacitor has a varactor diode.

Preferably, one end of the arbitrary waveform generator is coupled to the first pattern plate of the upper plate and the other end thereof is coupled to the lower plate.

Preferably, the arbitrary waveform generator generates and provides a voltage waveform so as to change a bias voltage of a variable capacitor corresponding to a desired resonant frequency.

Preferably, the arbitrary waveform generator generates a voltage waveform applied to the variable capacitor so as to linearly change a reflected wave phase to 360° on the metamaterial surface.

Preferably, metamaterial unit cells including a plurality of metamaterial unit structures are periodically disposed, respectively, and in the metamaterial unit cell, the metamaterial unit structures including one or more metamaterial unit structures configured with the same structure are configured in a form having a predetermined pattern or various sizes of metamaterial unit structures with the same structure is configured to have a predetermined pattern.

Preferably, metamaterial unit cells including a plurality of metamaterial unit structures are periodically disposed, respectively, and the metamaterial unit cell includes two or more metamaterial unit structures having shapes different from each other of polygonal or circular metamaterial unit structures to have a predetermined pattern.

According to another aspect of the invention to achieve the object described above, there is provided an ECM system, an equipment surface of which includes a plate-shaped active metamaterial surface configured to continuously convert a phase of a reflected wave by changing surface impedance characteristics in accordance with input voltage provided from an arbitrary waveform generator, and which includes an arbitrary waveform generator providing a voltage waveform changed in accordance with time to the metamaterial surface therein, wherein a plurality of metamaterial unit structures are periodically disposed on the metamaterial surface, and the metamaterial unit structure is a high impedance surface (HIS) provided with a variable capacitor, to change the capacitance of the variable capacitor in accordance with applied voltage.

Preferably, a radio communication means is additionally provided in the equipment and a voltage waveform output through the arbitrary waveform generator is changed and set on the basis of signals input by wireless.

Preferably, in the metamaterial unit structure, a dielectric plate with a predetermined thickness is disposed between a conductive lower plate and upper plate; the upper plate comprises a band-type first pattern plate with a hollow and a second pattern plate formed in the hollow of the first pattern plate, wherein a band-shaped line pattern formed by a separation interval is formed between the first pattern plate and the second pattern plate, thereby forming a capacitance component; and a variable capacitor is coupled between the first pattern plate and the second pattern plate and a center of the second pattern plate is connected to the lower plate via a via-pin thereby forming a grounding.

Preferably, at least one variable capacitor is coupled between the first pattern plate and the second pattern plate, wherein in a polygonal metamaterial unit structure, one variable capacitor is disposed on each side thereof.

Preferably, one end of the arbitrary waveform generator is coupled to the first pattern plate of the upper plate and the other end thereof is coupled to the lower plate.

Preferably, the arbitrary waveform generator generates and provides a voltage waveform so as to change a bias voltage of a variable capacitor corresponding to a desired resonant frequency.

Preferably, the arbitrary waveform generator generates a voltage waveform applied to the variable capacitor so as to linearly change a reflected wave phase to 360° on the metamaterial surface.

Preferably, metamaterial unit cells including a plurality of metamaterial unit structures are periodically disposed, respectively, and in the metamaterial unit cell, the metamaterial unit structures including one or more metamaterial unit structures configured with the same structure are configured in a form having a predetermined pattern or various sizes of metamaterial unit structures with the same structure is configured to have a predetermined pattern.

Preferably, metamaterial unit cells including a plurality of metamaterial unit structures are periodically disposed, respectively, and the metamaterial unit cell includes two or more metamaterial unit structures having shapes different from each other of polygonal or circular metamaterial unit structures to have a predetermined pattern.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENT

Hereinafter, the present invention can be variously changed and have various forms and the specific implementation examples in accordance with this invention are exemplified and explained in detail in reference to the drawings. However, since the present invention is limited by the specific embodiments, it should be understood that the scope of the invention includes all of the changes, the equivalents, and the substitutes for realizing the technical concept. Also, since the specific embodiments do not include all objects and effects presented by the present invention, the scope of the present invention is not limited by them. The detailed description about the prior related technology will also be omitted when it is judged to blur the gist of this invention in explaining this invention.

The terms used in this application do not intend to limit this invention, but are used only to explain specific implementation examples. The singular expression includes plural expressions unless it is apparently different in the context.

The terms such as "include", "equipped" or "have" in this application intend to designate that the feature, number, stage, movement, component, part or the combination described in the specification exist. Therefore, it will be understood that the existence or the additional possibility of one or more than one different features, numbers, stages, actions, components, parts and the combination is not excluded in advance.

Hereinafter, a reflection frequency conversion device using an active metamaterial surface and an electronic counter measures (ECM) system using the same according to the invention will be described with reference to the accompanying drawings.

Figure 1:
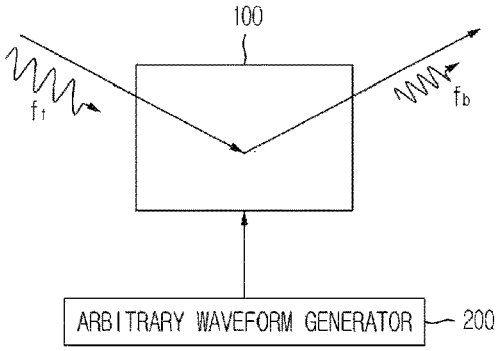
FIG. 1 is a diagram illustrating a schematic configuration of a reflection frequency conversion device using an active metamaterial surface according to a first embodiment of the invention.

FIG. 1 is a diagram illustrating a schematic configuration of a reflection frequency conversion device using an active metamaterial surface according to a first embodiment of the invention.

As illustrated in FIG. 1, a reflection frequency conversion device using a metamaterial surface includes an active metamaterial surface 100 which changes and outputs a phase of a reflection frequency by changing surface impedance characteristics on the basis of an input signal, and an arbitrary waveform generator 200 which provides a control signal for changing transfer characteristics of an incident wave input to the metamaterial surface 100 in time, that is, a voltage waveform.

The metamaterial surface 100 changes electrical characteristics of the metamaterial surface 100 by coupling a variable capacitor to a high impedance surface (HIS) structure, thereby changing a reflection frequency for an incident wave.

Figure 2:
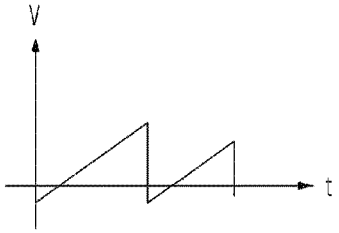
FIG. 2 is an example view illustrating a voltage waveform provided in an arbitrary waveform generator 200 shown in FIG. 1.

In addition, as illustrated in FIG. 2, the arbitrary waveform generator 200 provides a voltage waveform in a form of continuously changing a voltage level with respect to time to the metamaterial surface 100 to change electrical characteristics of the metamaterial surface 100, more specifically, surface impedance characteristics. More specifically, the arbitrary waveform generator 200 changes capacitance of a variable capacitor constituting the metamaterial surface 100 through a voltage waveform, thereby periodically and linearly changing a reflected wave phase on the metamaterial surface 100. In this case, the variable range of the reflected wave phase may be set to 360°.

In other words, the arbitrary waveform generator 200 generates and provides a voltage waveform corresponding to a bias of a variable capacitor corresponding to a desired resonant frequency, for example, a varactor diode. In this case, the arbitrary waveform generator 200 generates a voltage waveform and provides the voltage waveform to the metamaterial surface such that linear phase shift for the reflected wave in the metamaterial 100 occurs at a preset period with respect to time. The voltage waveform may be set such that phase shift of 360° for the reflected wave occurs, and the linear period of the voltage waveform may be arbitrarily set to be random.

Figure 3:
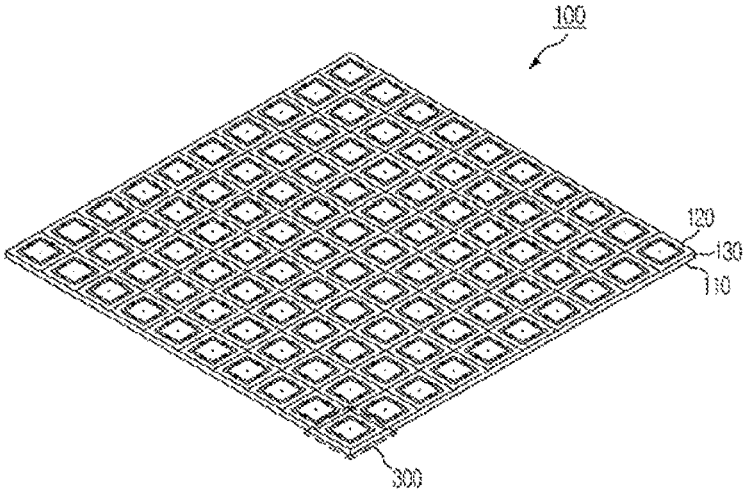
FIG. 3 is a diagram illustrating a schematic configuration of a metamaterial surface 100 shown in FIG. 1.

FIG. 3 is a diagram illustrating an example of a schematic shape of the metamaterial surface 100 illustrated in FIG. 1.

As illustrated in FIG. 3, the metamaterial surface 100 is formed in a plate shape, and a plurality of metamaterial unit structures 300 are periodically disposed thereon.

More specifically, in the metamaterial surface 100, basically, a dielectric plate 130 with a predetermined thickness is disposed between a conductive lower plate 110 and upper plate 120.

In addition, the upper plate 120 is provided with a predetermined form of pattern for changing a reflected wave frequency in accordance with voltage, and a plurality of predetermined patterns are periodically disposed.

In other words, in the metamaterial surface 100, the metamaterial unit structures 300 having a predetermined pattern are periodically disposed in terms of the predetermined pattern formed on the upper plate 120.

Figure 4A:
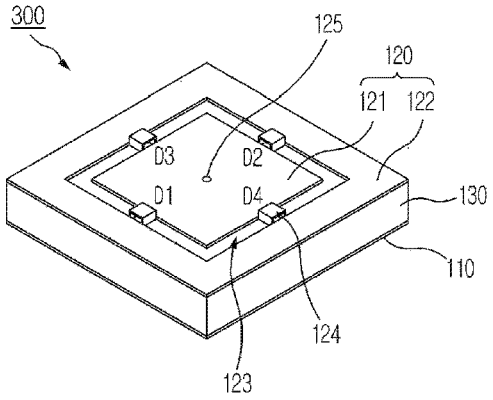
FIG. 4A and FIG. 4B are diagrams for explaining a configuration of a metamaterial unit structure 300 illustrated in FIG. 3.
Figure 4B:
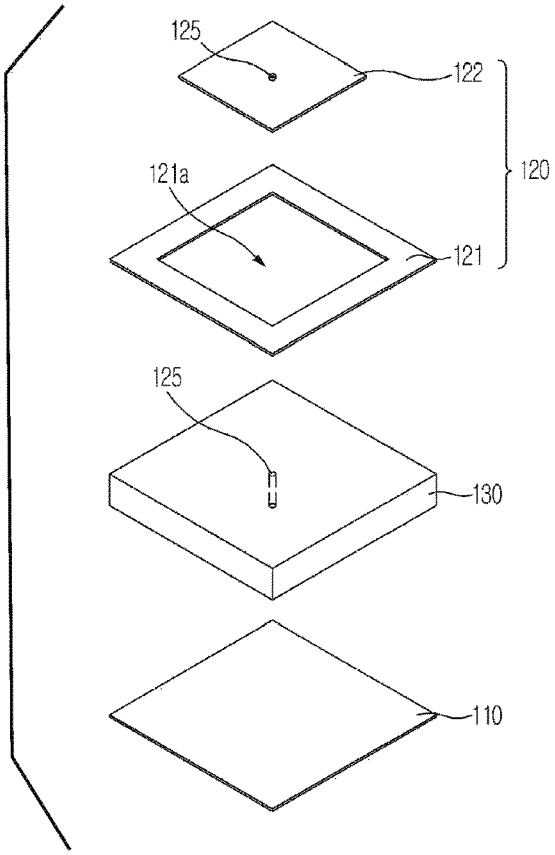

FIG. 4A and FIG. 4B are diagrams for explaining a configuration of the metamaterial unit structure 300 illustrated in FIG. 3, FIG. 4A is an appearance perspective view, and FIG. 4B is a separation perspective view of the lower plate 110, the upper plate 120, and the dielectric plate 130. In FIG. 4A and FIG. 4B, the metamaterial unit structure 300 configured in a rectangular shape is illustrated.

As illustrated in FIG. 4A and FIG. 4B, in the metamaterial unit structure 300, the dielectric plate 130 with a predetermined thickness is disposed between the lower plate 110 and the upper plate 120.

The upper plate 120 includes a band-type first pattern plate 121 with a hollow 121*a*, and a second pattern plate 122 formed in the hollow 121*a* of the first pattern plate 121. The second pattern plate 122 is disposed to form a predetermined interval with the first pattern plate 121. In other words, the size of the second pattern plate 122 is set to have an area smaller than an area of the hollow 121*a*. Accordingly, a band-shaped line pattern 123 formed by a separation interval is formed between the first pattern plate 121 and the second pattern plate 122, thereby forming a capacitance component.

In addition, at least one variable capacitor 124 is coupled between the first pattern plate 121 and the second pattern plate 122. As illustrated in FIG. 4A, when the metamaterial unit structure 300 is rectangular, a band-shaped, more specifically, rectangular band-shaped line pattern 123 is formed at a position separated from the outer edge of the upper plate 120 by a predetermined distance, and one variable capacitor is disposed on each side of four sides on the line pattern 123. In other words, first to fourth variable capacitors, for example, first to fourth varactor diodes (D1, D2, D3, and D4) with capacitance variable in accordance with voltage are configured on four sides on the line pattern 123 to be connected between the first pattern plate 121 and the second pattern plate 122.

In addition, a via-pin 125 is formed at the center of the upper plate 120 of the metamaterial unit structure 300, more specifically, the center of the second pattern plate 122 of the upper plate 120, to additionally set an inductance component. In this case, the via-pin 125 is connected to the lower plate 110 performing a grounding function, and the second pattern plate 122 of the upper plate 120 forms the same potential (ground) with the lower plate 110. Although not illustrated, one end of the arbitrary waveform generator 200 is coupled to the lower plate 110, and the other end is coupled to the first pattern plate 121 of the upper plate 120.

Figure 5A:
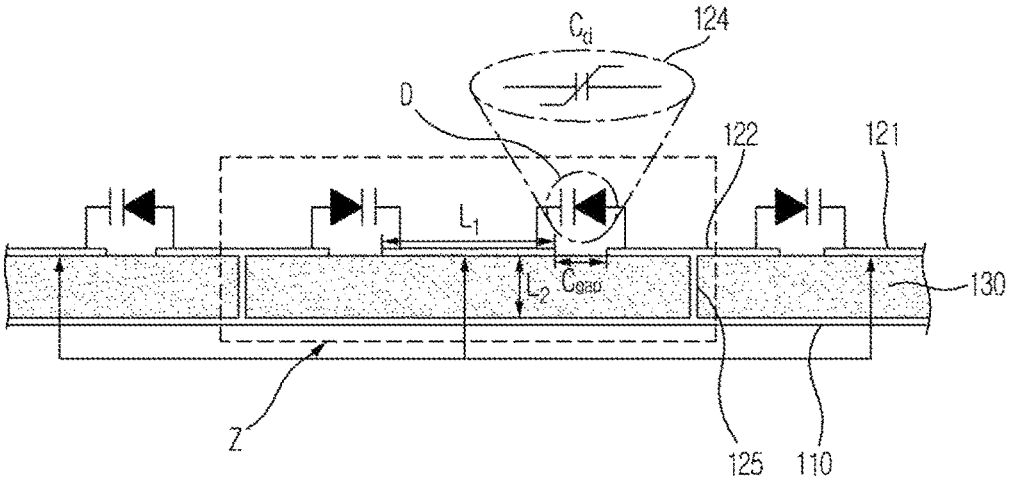
FIG. 5A and FIG. 5B are diagrams of electrically modeling a metamaterial unit structure 300 illustrated in FIG. 4.
Figure 5B:
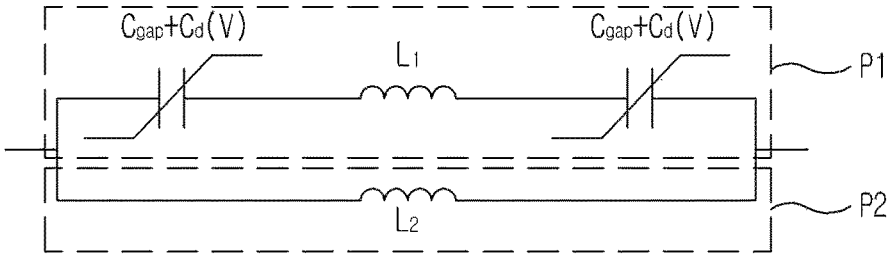
Figure 6A:
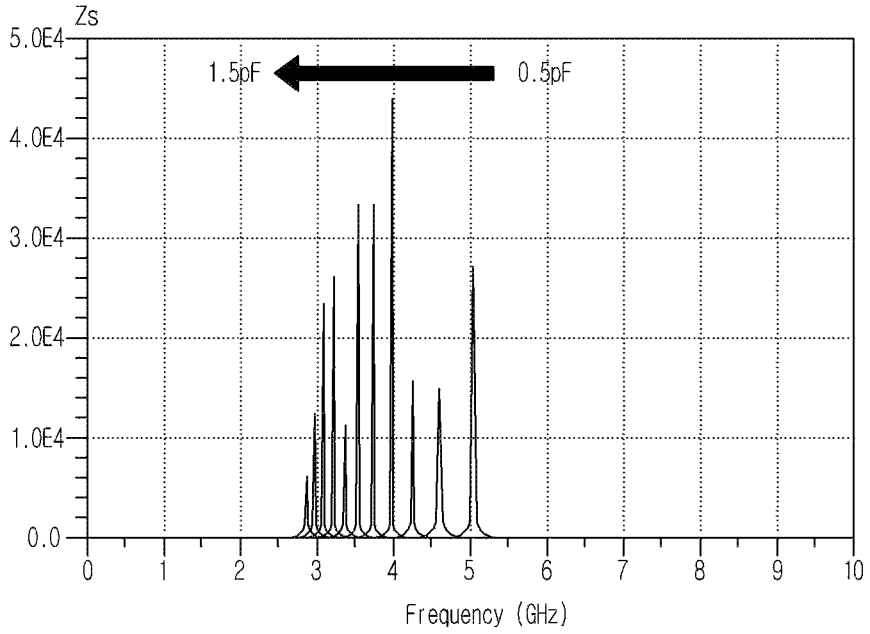
FIG. 6A and FIG. 6B are graphs illustrating characteristics of a metamaterial unit structure 300 illustrated in FIG. 4.
Figure 6B:
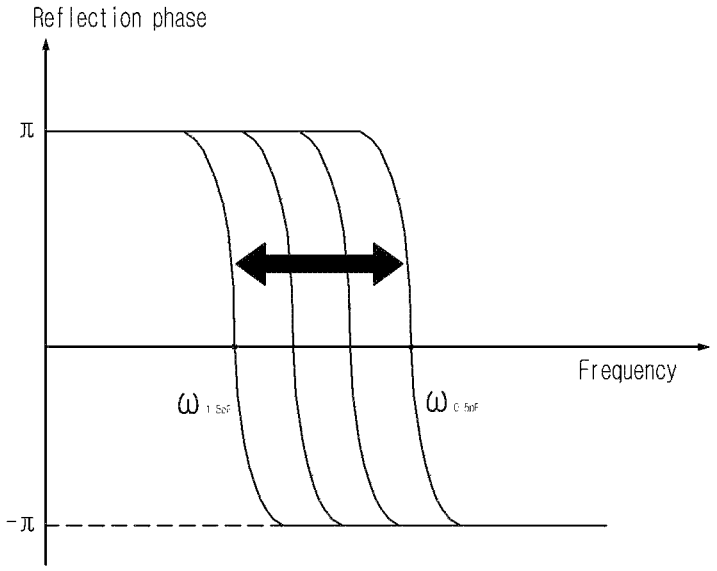

Meanwhile, FIG. 5A, FIG. 5B, FIG. 6A, and FIG. 6B are diagrams for explaining characteristics of the metamaterial unit structure 300 illustrated in FIG. 4A and FIG. 4B, FIG. 5A is a conceptual structural diagram of a metamaterial unit structure 300, FIG. 5B is a diagram illustrating an equivalent circuit of the metamaterial unit structure 300 illustrated in FIG. 5B. FIG. 6A is a diagram illustrating impedance magnitude of the metamaterial surface 100 according to change in capacitance, and FIG. 6B is a diagram illustrating resonant frequency characteristics of the metamaterial surface 100 according to change in capacitance.

As illustrated in FIG. 5A, the metamaterial unit structure 300 is provided with a variable capacitor 124 coupled between the first pattern plate 121 and the second pattern plate 122 of the upper plate 120, and is connected to the lower plate 110 through the via-pin 125 of the second pattern plate 122. In this case, the variable capacitor 124 may be formed of a varactor diode (D).

FIG. 5B illustrates an equivalent circuit for a dotted-line portion Z of the metamaterial unit structure 300 illustrated in FIG. 5A, and the equivalent circuit may be represented by a structure in which a first path P1 and a second path P2 are coupled in parallel.

The first path P1 is configured in a form in which variable capacitors including a first capacitance component Cd corresponding to a varactor diode D and a second capacitor component Cgap based on a line pattern 123 formed by a separation distance between the first pattern plate 121 and the second pattern plate 122, which are synthesized, are connected in series to a first inductor $L_1$ corresponding to the length of the line pattern 122 between the variable capacitors 124. In other words, in the invention, the variable capacitor is varied in correspondence with input voltage through the varactor diode D.

In addition, the second path P2 includes a second inductor $L_2$ corresponding to the thickness of the dielectric plate 130. In this case, an inductance component may be additionally set by the via-pin 125 connecting the center of the upper plate 120 to the lower plate 110.

FIG. 6A illustrates impedance characteristics Zs of the metamaterial surface 100 induced from the equivalent circuit illustrated in FIG. 5B. As illustrated in FIG. 6A, it can be seen to change a frequency being high impedance in accordance with capacitance. In other words, the active metamaterial surface 100 according to the invention is a kind of reflected wave phase shifter capable of adjusting a phase of a reflected wave in accordance with voltage by applying a diode which is an active device to a passive HIS structure, and automatically changes the phase of the reflected wave through the change in impedance characteristics of the metamaterial surface 100.

FIG. 6B illustrates resonant frequency characteristics according to the change in capacitance on the basis of the impedance characteristics illustrated in FIG. 6A. The resonant frequency ω is a frequency at the point where a phase of a reflected wave is 0°, and it can be seen that the resonant frequency ω is changed in accordance with the change in capacitance. FIG. 6B illustrates an example of a resonant frequency $\omega_{1.5pF}$ in a state where the capacitor is 1.5 pF to a resonant frequency $\omega_{0.5pF}$ in a state where the capacitor is 0.5 pF state. In other words, it can be seen that the resonant frequency gets higher as reverse bias voltage applied to the varactor diode gets higher through FIG. 6B.

Figure 7:
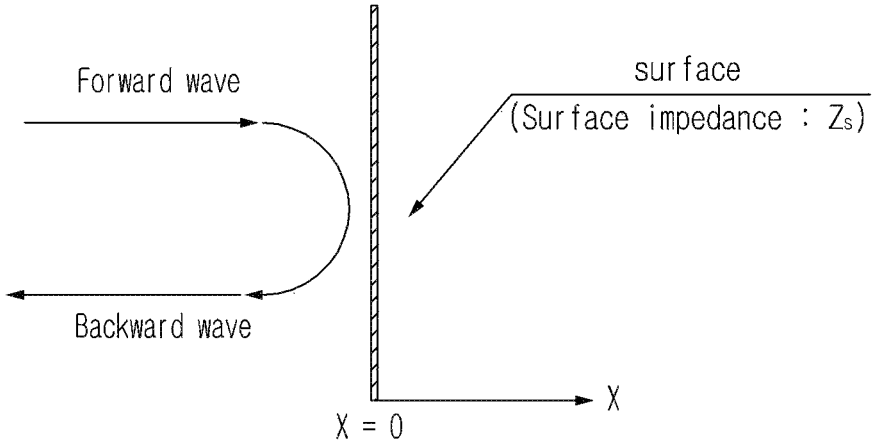
FIG. 7 is a diagram illustrating space modeling for formula induction related to a metamaterial surface 100.

Subsequently, electrical characteristics of the active metamaterial surface 100 and a principle of change in reflection frequency using the same will be described in more detail. FIG. 7 is a diagram illustrating space modeling for formula induction related to the metamaterial surface 100, an incident wave (forward propagation), a reflected wave (backward propagation), and a surface are illustrated therein.

First, as illustrated in FIG. 7, generally, when an electromagnetic wave having TEM characteristics is input to the surface S, a standing wave equation is as Equation 1.

$$E(x)=E_f e^{-jkx}+E_b e^{jkx}$$

$$H(x)=H_f e^{-jkx}+H_b e^{jkx} \quad \text{[Equation 1]}$$

E(x) denotes electric field, H(x) denotes magnetic field, subscript f means forward propagation, and subscript b means backward propagation.

In this case, surface impedance and characteristic impedance of air can be defined as Equation 2.

$$\frac{E_{total}(x=0)}{H_{total}(x=0)} = Z_s \quad \text{[Equation 2]}$$

$$\left|\frac{E_t(x)}{H_t(x)}\right| = \left|\frac{E_b(x)}{H_b(x)}\right| = \sqrt{\frac{\mu_0}{\epsilon_0}} = \eta_0$$

Zs denotes surface impedance, and $\eta_0$ denotes unique impedance of free space. It is possible to calculate a reflection coefficient Γ by using Equation 2. Equation 3 is an equation for calculating a reflection coefficient on the surface.

$$\Gamma = \frac{Z_s - \eta_0}{Z_s + \eta_0} \quad \text{[Equation 3]}$$

In addition, it is possible to calculate a phase $\Phi_R$ of a reflected wave by using Equation 3. Equation 4 is an equation for calculating a phase of a reflected wave.

$$\phi_R = \mathrm{Im}\left\{\ln\left(\frac{E_b}{E_t}\right)\right\} = \mathrm{Im}\left\{\ln\left(\frac{Z_s - \eta_0}{Z_s + \eta_0}\right)\right\} \quad \text{[Equation 4]}$$

In this case, numbers in parentheses of Im means an imaginary part. The surface impedance depends on physical characteristics of the surface. In case of a conductive plate, the value has 0°, and thus the phase of the reflected wave is 180°. In this case, the surface impedance may be modeled in parallel connection of an inductor and a capacitor, and thus it can e seen that a resonant frequency occurs.

The present inventor designed a structure of the metamaterial surface 100 by using the varactor diode and the pattern line 122 to model an LC resonant circuit as illustrated in FIG. 5A and FIG. 5B. The impedance in the metamaterial unit structure 300 illustrated in FIG. 5A and FIG. 5B means surface impedance Zs.

Accordingly, an equation in a time domain of a reflected wave may be represented as Equation 5.

$$E_b(x,t) = E_f e^{-Rs\{\ln(\Gamma)\}}\cos[\omega t + kx - \mathrm{Im}\{\ln(\Gamma)\}] = E_f\cos\left[\omega t + kx - \mathrm{Im}\left\{\tanh^{-1}\left(\frac{\eta_0}{Z_s}\right)\right\}\right] \quad \text{[Equation 5]}$$

In addition, Equation 5 may be arranged as Equation 6 on the basis of the equivalent circuit of the metamaterial unit structure 300 modeled as illustrated in FIG. 6A.

$$E_b(x,t) = E_f\cos\left[\omega t + kx - \mathrm{Im}\left\{\tanh^{-1}\left\{\frac{\eta_0\{2-\omega^2(L_1+L_2)(C_d(V)+C_{gap})\}}{j\omega L_2\{2-\omega^2 L_1(C_d(V)+C_{gap})\}}\right\}\right\}\right] \quad \text{[Equation 6]}$$

In Equation 6, a term variable by voltage is $C_d(V)$ which is capacitance of the varactor diode. In this case, the capacitance of the varactor diode according to adjustment voltage V may be represented as Equation 7.

$$C_d(V) = \frac{C_{JO}}{\left(1+\frac{V}{V_{bs}}\right)^{\frac{1}{m+2}}} \quad \text{[Equation 7]}$$

$C_{JO}$ denotes capacitance in a zero-bias state of the varactor diode, $V_{bi}$ denotes built-in voltage of the varactor diode, and m denotes an index representing doping characteristics of the varactor diode.

In this case, when a voltage waveform changed in accordance with time is applied to the metamaterial surface 100 to change the surface impedance of the metamaterial surface 100 in accordance with time, a phase of a reflected wave is changed by time, and the time domain equation of the reflected wave may be represented as Equation 8. In other words, the capacitance of the varactor diode is changed in accordance with the applied voltage, and the phase of the reflected wave is changed in correspondence with the change.

$$E_b(x,t)=E_f \cos[\omega t+kx-\Phi_R\{V(t)\}] \quad \text{[Equation 8]}$$

Figure 8A:
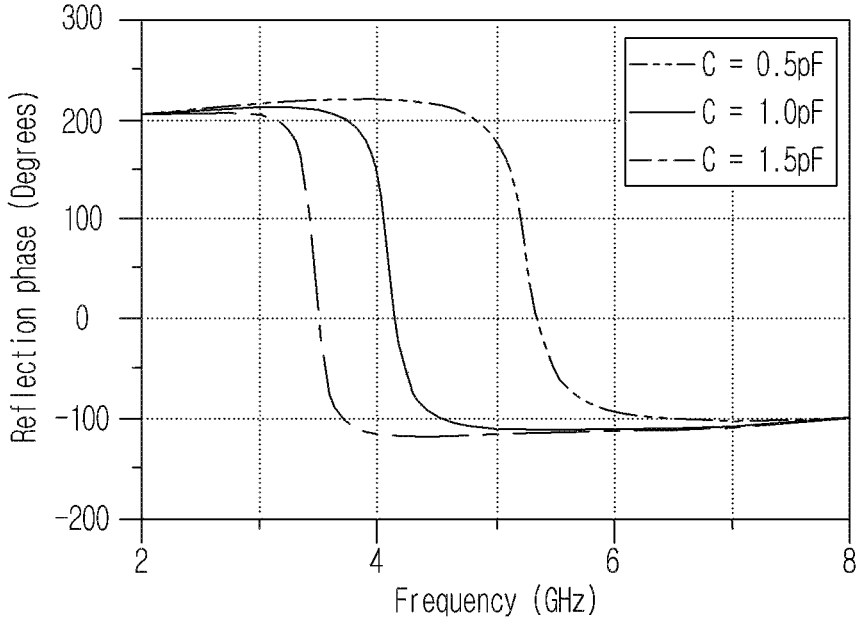
FIG. 8A and FIG. 8B are diagrams illustrating characteristics of a reflected wave according to change in capacitance on a metamaterial surface 100, and it can be seen that the phase of the reflected wave.

Meanwhile, the phase relation of the reflected wave with respect to the applied voltage is very non-linear, and thus distortion of the reflected wave may occur in accordance with the waveform input by the adjustment voltage (see FIG. 8A). In the invention, an arbitrary waveform generator 200 is embodied to linearly correct the distortion of the reflected wave, the reflected wave is corrected, and it is possible to linearly generate the reflected wave $\varphi_R\{V(t)\}$ with respect to time. The time domain equation of the reflected wave may be represented as Equation 9.

$$E_b(x,t)=E_t \cos(\omega t+kx-At)=E_t \cos((\omega-\Delta\omega)t+kx) \quad \text{[Equation 9]}$$

In other words, this means that it is possible to change the frequency of the reflected wave with respect to the incident wave provided to the metamaterial surface 100 by using low power of a level capable of changing reverse voltage of the varactor diode configured on the metamaterial surface 100 provided from the arbitrary waveform generator 200.

Figure 8B:
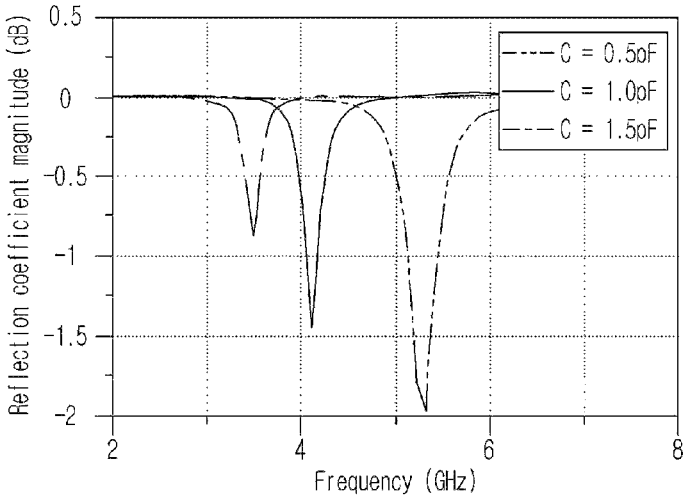

FIG. 8A and FIG. 8B are diagrams illustrating response characteristics acquired by applying a TEM wave to the surface an EM simulator corresponding to the invention.

FIG. 8A illustrates a phase of a reflected wave according to change in capacitance, and it can be seen that the phase of the reflected wave is 0° in the resonant frequency and it is possible to change the resonant frequency by adjusting the capacitance of the varactor diode. In addition, FIG. 8B illustrates magnitude a reflection coefficient for change in capacitance, and it can be seen that the magnitude of the reflection coefficient is close to 1. This means that it is possible to change the phase of the reflected wave by using adjustment voltage substantially without loss on the surface.

Meanwhile, FIG. 9A, FIG. 9B, and FIG. 10A to FIG. 10C are diagrams illustrating an experiment result of the inventor for the reflection frequency conversion device using an active metamaterial surface according to the invention.

Figure 9A:
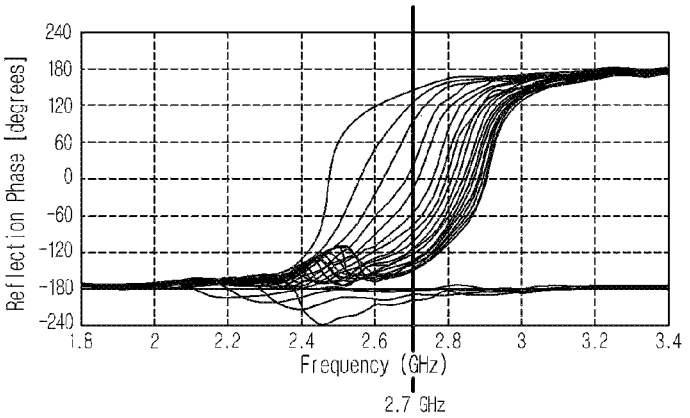
FIG. 9A through FIG. 10C are diagrams illustrating experiment results on a reflection frequency conversion device using an active metamaterial surface according to the present invention.
Figure 9B:
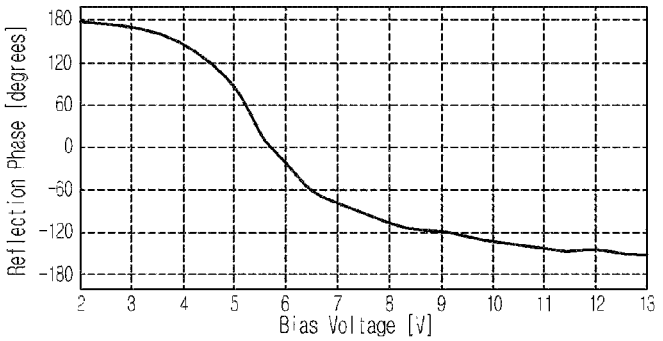

FIG. 9A and FIG. 9B illustrate an experiment result obtained by measuring change in phase of a reflected wave for applied voltage.

FIG. 9A illustrates change in phase of a reflected wave for change in capacitance, and FIG. 9B illustrates change in phase of a reflected wave for applied voltage in 2.7 GHz. According to FIG. 9B, it can be seen that change in phase of about 360° of −180° to 180° occurs within the voltage range of 2 to 13 V.

In addition, FIG. 10 illustrates a graph of a reflected phase for applied voltage in 2.7 GHz. In this case, the frequency of the applied voltage is set to 10 KHz.

Figure 10A:
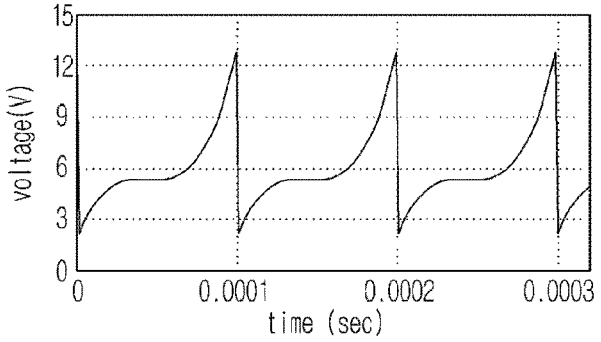

FIG. 10A illustrates applied voltage for linear 360° phase shift when the frequency of the incident wave is 2.7 GHz, and the frequency of the applied voltage is set to 10 KHz.

Figure 10B:
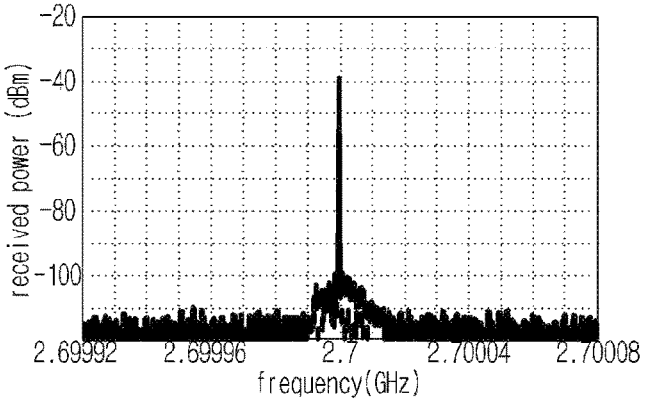
Figure 10C:
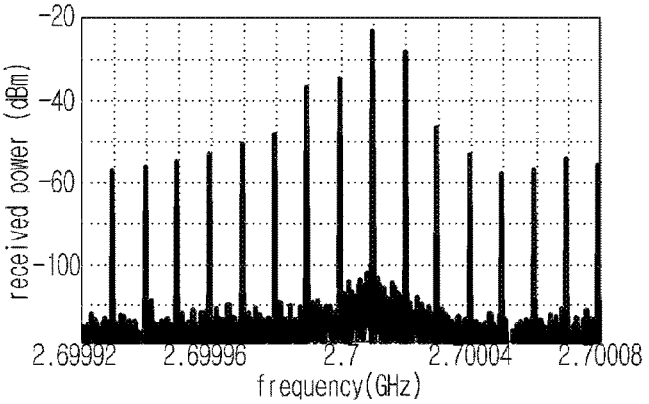

In addition, FIG. 10B is a graph illustrating a result of measurement of reflected wave frequency spectrum on a general conductor plane, and FIG. 10C is a graph illustrating reflected wave frequency spectrum on the metamaterial surface according to the invention. As illustrated in FIG. 10B, on the conductor plane, a reflected wave is generated only for 2.7 GHz. However, on the metamaterial surface according to the invention, as illustrated in FIG. 10C, it can be seen that the frequency of the reflected wave is changed by 10 KHz in 2.7 GHz. Accordingly, it can be seen that it is possible to convert and output the reflected wave into a desired frequency by using the metamaterial surface according to the invention.

Meanwhile, in the embodiment, as illustrated in FIG. 3, FIG. 4A, and FIG. 4B, the rectangular metamaterial unit structures 300 are periodically disposed to embody the metamaterial surface 100 according to the invention. However, the metamaterial surface 100 is not limited thereto, and may be embodied in various forms having various patterns.

FIG. 11 to FIG. 16 illustrate examples of various shapes of metamaterial surfaces 101 to 106, and forms of metamaterial unit cells 301 to 306 corresponding thereto.

As illustrated in FIG. 11 to FIG. 15, in the metamaterial surfaces 101 to 105, metamaterial unit cells 301 to 305 including a plurality of metamaterial unit structures are periodically disposed, respectively.

Figure 11:
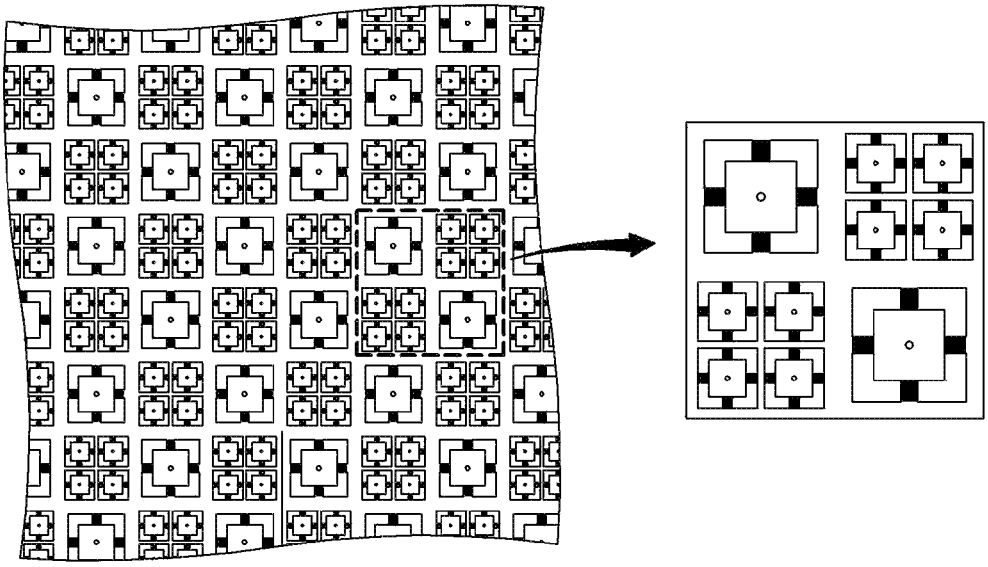
FIG. 11 to FIG. 16 illustrates examples of various shapes of metamaterial surfaces and forms of metamaterial unit cells according to the present invention.
Figure 12:
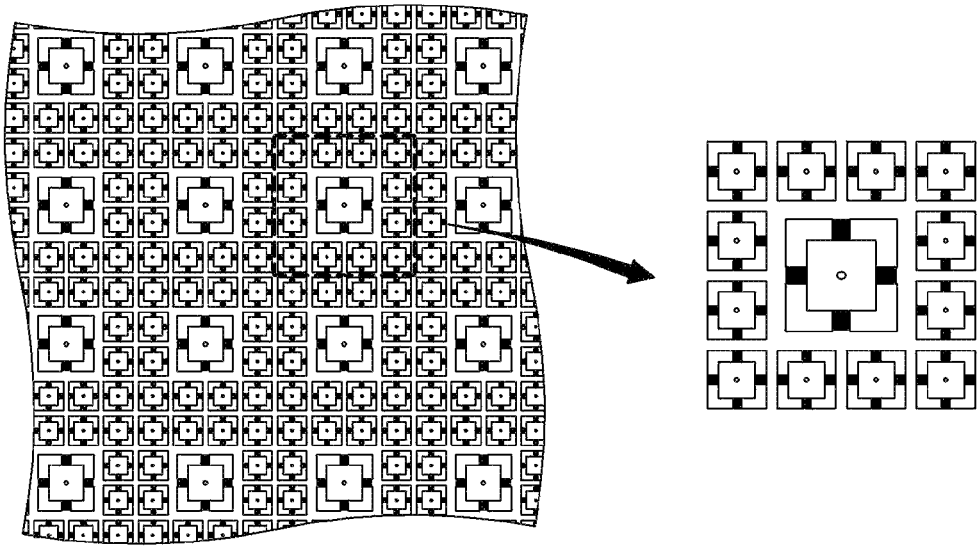
Figure 13:
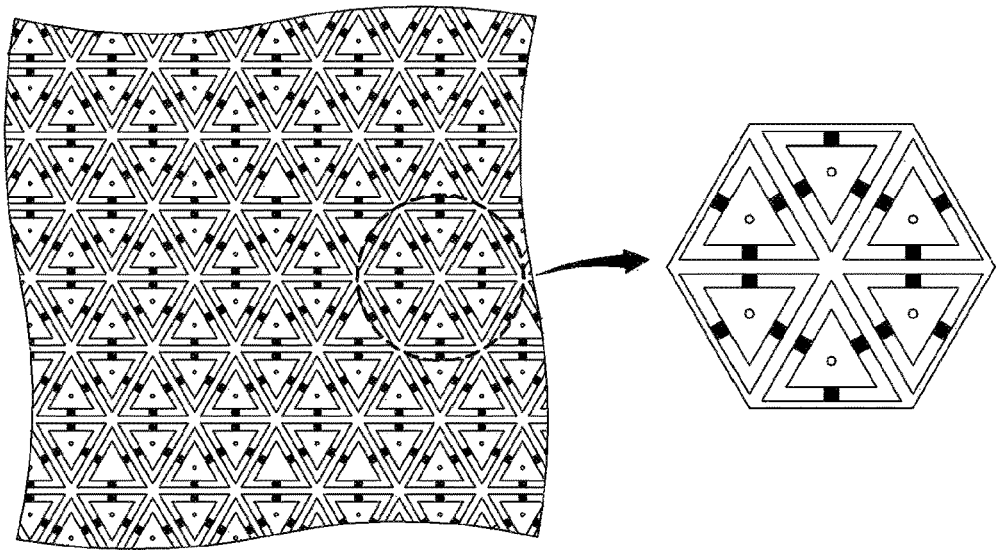

In other words, in the metamaterial unit cell, metamaterial unit structures including one or more metamaterial unit structures which is configured with the same structure are configured in a form having a predetermined pattern (FIG. 11 to FIG. 13), or various sizes of metamaterial unit structures with the same structure may be configured to have a predetermined pattern (FIG. 11 and FIG. 12). For example, the metamaterial unit cell may include a plurality of rectangular or triangular metamaterial unit structures (FIG. 11 to FIG. 13).

Figure 14:
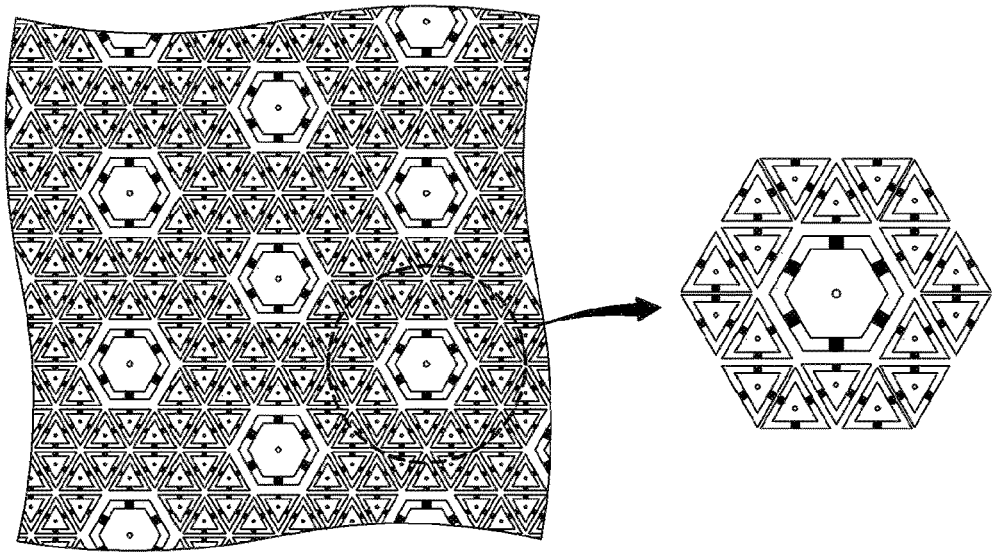
Figure 15:
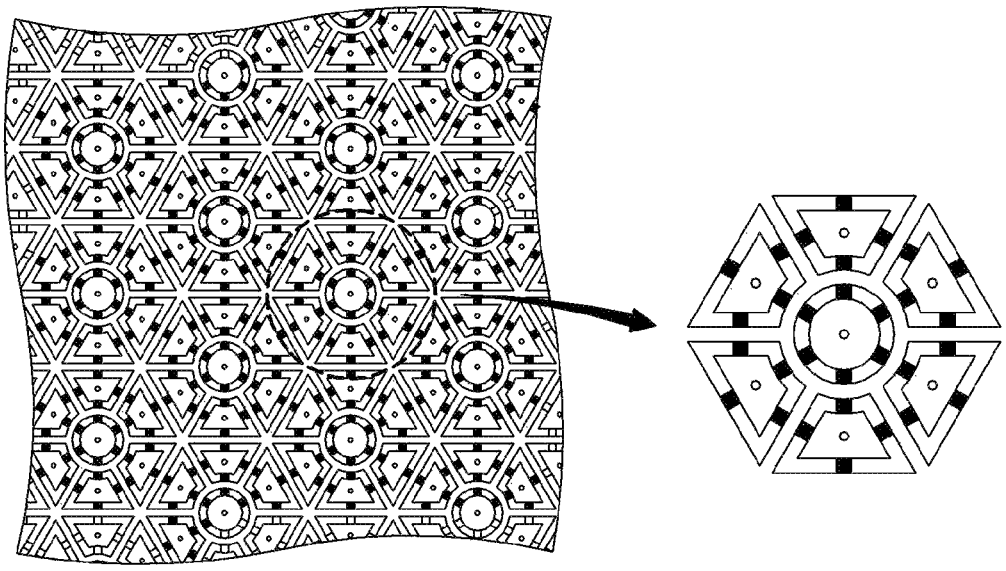

In addition, the metamaterial unit cell may include two or more metamaterial unit structures having shapes different from each other of polygonal or circular metamaterial unit structures having sizes or shapes different from each other, to have a predetermined pattern (FIG. 14 and FIG. 15). For example, the metamaterial unit cell may include a plurality of triangular metamaterial unit structures around a hexagonal metamaterial unit structure (FIG. 14), or may include a plurality of trapezoid-shaped metamaterial unit structures around a circular metamaterial unit structure (FIG. 15).

Figure 16:
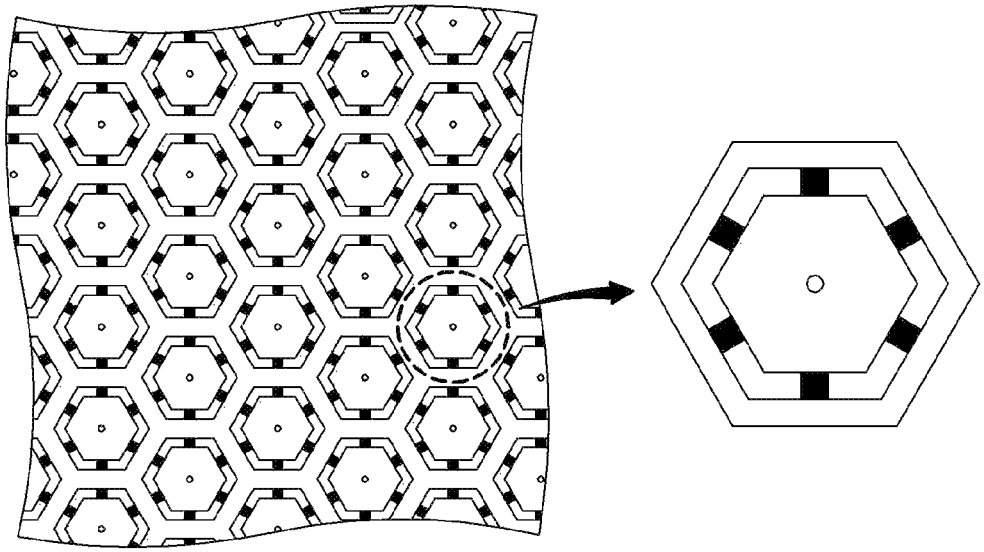

In addition, the metamaterial surface may include polygonal, for example, triangular, pentagonal, and hexagonal metamaterial unit structures in addition to a rectangular shape. For example, as illustrated in FIG. 16, the metamaterial surface 106 may include a plurality of hexagonal metamaterial unit structures 306.

In addition, in the invention, it is possible to embody a new type of ECM system by applying the reflection frequency conversion device using an active metamaterial surface to various devices used in electronic warfare.

In other words, recently, fighter planes, and radars and missiles for detecting and intercepting them appear, electronic equipment in modern warfare is an important element indispensable in military operations as development of military radio communication techniques, and operations are performed in a complex information environment in which there are various frequencies and magnitudes of electromagnetic spectrum in battlefield. In such an environment, importance of electronic warfare of smoothly performing exchange of electromagnetic spectrum used in our forces and incapacitating electromagnetic spectrum used in enemy forces arises. The electronic warfare is mainly classified into three kinds of electronic attack of incapacitating electromagnetic radiation weapons of enemy forces, electronic defense of protecting electronic equipment from electronic attack from enemy forces, and electronic support of blocking electromagnetic spectrum of our forces and collecting and wiretapping electromagnetic spectrum energy of enemy forces.

The electronic attack of the warfare includes methods such as interference missile launching, high-power radiation, jamming, and deception. The high-power radiation method is a technique of radiating electromagnetic pulses (EMP) which are signals including signals of various frequencies with high power to incapacitate radar equipment of enemy forces, is configured to momentarily generate a high-power electromagnetic wave by using a large capacitor bank, a single loop antenna, a high-power microwave generator, an explosively pumped flux compression generator (EPFCG) to generate EMP. However, the high-power radiation has an influence on both of our forces and enemy forces, and thus utilization thereof is limited.

In addition, the jamming is a technique of radiating a strong interference electromagnetic wave to a radar of enemy forces to incapacitate the radar of the enemy forces, there are many jamming methods in accordance with types of radars to be incapacitated, commonly, it is necessary to radiate a signal stronger than a signal reflected from a fighter plane and returning to a radar, and thus there is a disadvantage that high-power microwave equipment is necessary.

In addition, the deception is a technique of allowing a radar not to identify an airframe, and uses a technique of flying over a radar detection height, design of airplanes to reduce a radar reflection area, and application of radar absorbent material (RAM). The technique of flying over a detection height lost usefulness a long time ago while a detection height gets higher as a radar technique is significantly developed currently. When an airplane is designed by reducing a radar reflection area, there is a disadvantage that the airplane cannot be designed hydrodynamically. The radar absorbent material has to be continuously applied to the surface of a fighter plane, and there is a limit that maintenance conditions are very difficult.

In addition, hitherto, the ECM technique is mainly used only for aircrafts. However, recently, unmanned aerial vehicles appear, at least one of communication equipment is provided in various combat platforms, and thus demands of ECM techniques for interference thereof are gradually increased.

Figure 17:
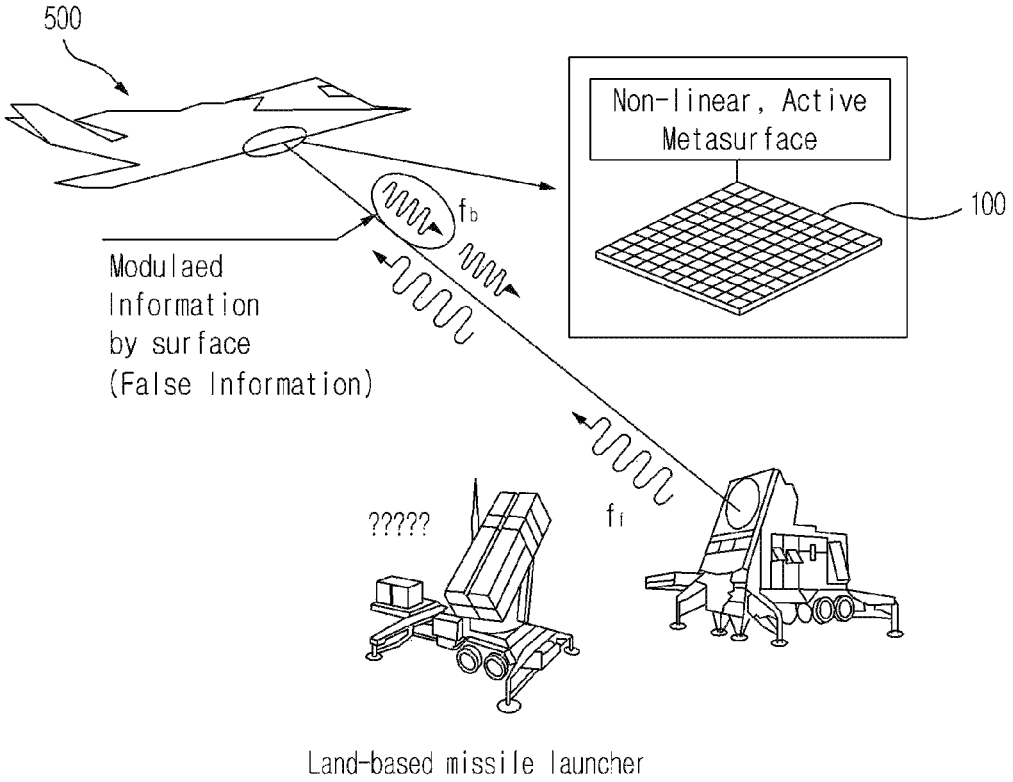
FIG. 17 is a diagram illustrating a schematic configuration of an ECM system using an active metamaterial surface according to a first embodiment of the invention.

Accordingly, as illustrated in FIG. 17, the surfaces of various kinds of electronic warfare equipment 500 such as aircrafts, drones, small robots, and armored vehicles are configured with the active metamaterial surfaces 100, an arbitrary waveform generator (not illustrated) is provided therein to set a voltage waveform by a driver, and thus it is possible to easily embody an EDM system.

In this case, the ECM system is configured to include radio communication means (not illustrated), and a manager may remotely change a voltage waveform of the arbitrary waveform generator positioned in the electronic warfare equipment 500. In other words, radio communication means is additionally provided in the equipment, and control means (not illustrated) in the equipment may change and set a voltage waveform output through the arbitrary waveform generator on the basis of signals input by wireless from the outside.

Accordingly, a high-power microwave device provided for jamming or deception in the conventional ECM system is not necessary, and thus it is possible to easily embody the ECM system even in small equipment such as a small robot, an armored vehicle, and a drone.

According to the present invention, it can provide the reflection frequency conversion device using the active metamaterial surface capable of converting the reflected frequency according to the input voltage waveform by means of the simple method in that the variable capacitor is coupled to the HIS in a regular pattern.

Also, where the reflection frequency conversion device using the active metamaterial surface according to the present invention is applied to the ECM system, since the signals received from the enemy are distorted on the surface of the equipment by using low power to be reflected, the delivery efficiency of the jamming signal is excellent and the miniaturization thereof is possible in comparison with the conventional ECM system. Accordingly, it can be applied to and utilized in various equipment including the small weapon systems etc. such as an airplane, an UAV, a small robot, an armored car.

While the present invention has been described with respect to the specific embodiments, it will be apparent to those skilled in the art that various changes and modifications may be made without departing from the spirit and scope of the invention as defined in the following claims.

What is claimed is:

1. A reflection frequency conversion device using an active metamaterial surface comprising:

a plate-shaped active metamaterial surface which is configured to continuously convert a phase of a reflected wave by changing surface impedance characteristics in accordance with input voltage; and an arbitrary waveform generator which provides a voltage waveform in a form of linearly and periodically changing a voltage level with respect to time to the metamaterial surface, wherein the phase of the reflected wave is linearly and periodically changed with respect to the time through the voltage waveform, wherein a reflection frequency generated on the metamaterial surface is converted in accordance with a frequency of the voltage waveform provided from the arbitrary waveform generator, wherein a plurality of metamaterial unit structures are periodically disposed on the metamaterial surface, wherein each of the plurality of metamaterial unit structures is a high impedance surface (HIS) having at least one variable capacitor, and the capacitance of each of the at least one variable capacitor is changed in accordance with the voltage waveform to change the phase of the reflected wave, wherein in each of the plurality of metamaterial unit structures, a dielectric plate with a predetermined thickness is disposed between a conductive lower plate and upper plate, wherein the upper plate comprises a band-shaped first pattern plate with a hollow and a second pattern plate disposed in the hollow of the first pattern plate, wherein a band-shaped line pattern is formed by a separation interval located between the first pattern plate and the second pattern plate, thereby forming a capacitance component; and wherein each of the at least one variable capacitor is coupled between the first pattern plate and the second pattern plate and a center of the second pattern plate is connected to the lower plate via a via-pin thereby forming a grounding.

2. The reflection frequency conversion device of claim 1, wherein each of the plurality of metamaterial unit structures has a polygonal shape, and each of the at least one variable capacitor is disposed on each side thereof.

3. The reflection frequency conversion device of claim 2, wherein each of the at least one variable capacitor has a varactor diode.

4. The reflection frequency conversion device of claim 1, wherein one end of the arbitrary waveform generator is coupled to the first pattern plate of the upper plate and another end thereof is coupled to the lower plate.

5. The reflection frequency conversion device of claim 1, wherein the arbitrary waveform generator generates and provides the voltage waveform so as to change a bias voltage of a variable capacitor corresponding to a desired resonant frequency.

6. The reflection frequency conversion device of claim 5, wherein the arbitrary waveform generator generates the voltage waveform applied to the variable capacitor so as to linearly change a reflected wave phase to 360° on the metamaterial surface.

7. The reflection frequency conversion device of claim 1, wherein the reflection frequency conversion device comprises one or more metamaterial unit cells, wherein the one or more metamaterial unit cells are periodically disposed on the metamaterial surface, wherein each of the one or more metamaterial unit cells includes the plurality of metamaterial unit structures having various sizes with the same structure.

8. The reflection frequency conversion device of claim 1, wherein the reflection frequency conversion device comprises one or more metamaterial unit cells, wherein the one or more metamaterial unit cells are periodically disposed on the metamaterial surface, wherein each of the one or more metamaterial unit cells includes the plurality of metamaterial unit structures having polygonal shapes different from each other.

* * * * *